US005847734A

United States Patent [19]

Pawlowski, Jr.

[11] Patent Number: 5,847,734

[45] Date of Patent: Dec. 8, 1998

[54] AIR PURGE SYSTEM FOR AN INK-JET PRINTER

[76] Inventor: Norman E. Pawlowski, Jr., 1455 NW. 13th St., Corvallis, Oreg. 97330

[21] Appl. No.: 566,644

[22] Filed: Dec. 4, 1995

[51] Int. Cl.[6] ..... B41J 2/175

[52] U.S. Cl. ..... 347/86; 347/92

[58] Field of Search ..... 347/86, 92

[56] References Cited

U.S. PATENT DOCUMENTS

| | | |
|---|---|---|
| 594,196 | 11/1897 | Cramer . |
| 714,264 | 11/1902 | Turajski . |
| 743,798 | 11/1903 | Allwardt . |
| 1,150,420 | 8/1915 | Davis et al. . |
| 1,304,814 | 5/1919 | Schweinert et al. . |
| 1,451,037 | 4/1923 | Blanchard . |
| 1,563,331 | 12/1925 | Bright . |
| 1,588,898 | 6/1926 | Martocello . |
| 1,638,488 | 8/1927 | Kellogg . |
| 1,759,872 | 5/1930 | Schwimmer . |
| 1,767,391 | 6/1930 | Muller . |
| 1,850,879 | 3/1932 | Hunt . |
| 1,859,018 | 5/1932 | Bedford . |
| 1,918,602 | 7/1933 | Joyce . |
| 2,011,639 | 8/1935 | Johannesson . |
| 2,024,682 | 12/1935 | Eisenman . |
| 2,086,569 | 7/1937 | Meyer . |
| 2,092,116 | 9/1937 | Hansen . |
| 2,258,919 | 10/1941 | Wallace . |
| 2,265,267 | 12/1941 | Cowles . |
| 2,288,565 | 6/1942 | Green . |
| 2,327,611 | 8/1943 | Scheiwer . |
| 2,370,182 | 2/1945 | Morrow et al. . |
| 2,373,886 | 4/1945 | Geiger . |
| 2,412,685 | 4/1946 | Hoffman et al. . |
| 2,434,167 | 1/1948 | Knoblauch . |
| 2,459,477 | 1/1949 | Schuyver . |
| 2,492,271 | 12/1949 | Cox et al. . |
| 2,557,807 | 6/1951 | Wagner . |
| 2,598,009 | 5/1952 | Peeps . |
| 2,612,389 | 9/1952 | MacGlashan . |
| 2,727,759 | 12/1955 | Elliott . |
| 2,789,838 | 4/1957 | Palm . |
| 2,842,382 | 7/1958 | Franck . |
| 2,888,173 | 5/1959 | Wolcott . |
| 2,915,325 | 12/1959 | Foster . |
| 2,919,935 | 1/1960 | Nyberg . |
| 2,925,103 | 2/1960 | Kerr . |
| 3,102,770 | 9/1963 | McKeegan . |
| 3,104,088 | 9/1963 | Cator . |
| 3,106,379 | 10/1963 | Sciuto . |
| 3,140,912 | 7/1964 | Davis et al. . |

(List continued on next page.)

*Primary Examiner*—Jeffrey L. Sterrett

[57] ABSTRACT

An ink jet printer having an air purge feature that eliminates air from an ink delivery pathway. The printer includes an ink jet pen body housing having a containment chamber for holding ink, and a printhead that draws ink by capillary action from the containment chamber into a firing chamber and expels ink droplets through orifices. A remote supply of ink provides ink directly to the containment chamber through a supply line that directly communicates with the containment chamber and pulls ink from the remote supply as ink in the pen is used during printing. The pen is initialized by introducing ink under pressure from the remote supply into the supply line until ink fills the supply line and entire containment chamber with ink. Air is vented out of the supply tube and containment chamber as ink fills them. In a disclosed embodiment, the remote supply of ink is provided with a main reservoir coupled to a variable volume chamber pump through a one-way valve that allows the flow of ink from the reservoir to the pump and prevents the flow of ink from the pump to the reservoir. When the ink supply is installed in a printer, a fluid communication is established between the pump and the printer. The pump provided with the ink supply can be actuated to supply ink under positive pressure from the reservoir to the printhead, thereby flushing air from the ink delivery pathway. The supply of ink is preferably lower than the ink jet pen to maintain a back pressure on ink in the pen and prevent drooling from the orifices.

20 Claims, 7 Drawing Sheets

U.S. PATENT DOCUMENTS

| | | | |
|---|---|---|---|
| 3,152,452 | 10/1964 | Bond, Jr. et al. . | |
| 3,157,314 | 11/1964 | Nadler . | |
| 3,170,667 | 2/1965 | Szohatzky . | |
| 3,223,117 | 12/1965 | Curie et al. . | |
| 3,230,964 | 1/1966 | Debrotonic . | |
| 3,279,497 | 10/1966 | Norton et al. . | |
| 3,339,883 | 9/1967 | Drake . | |
| 3,359,015 | 12/1967 | Zahuranec . | |
| 3,430,824 | 3/1969 | Conners et al. . | |
| 3,490,473 | 1/1970 | Ehrens et al. . | |
| 3,493,146 | 2/1970 | Conners et al. . | |
| 3,537,477 | 11/1970 | Mahoff . | |
| 3,613,959 | 10/1971 | Mason | 222/187 |
| 3,614,940 | 10/1971 | Abrams et al. . | |
| 3,640,309 | 2/1972 | Demier, Sr. | 137/614.04 |
| 3,708,798 | 1/1973 | Hildenbrand et al. | 346/140 |
| 3,777,771 | 12/1973 | De Visscher | 137/1 |
| 3,777,782 | 12/1973 | Shendure | 137/614.04 |
| 3,787,882 | 1/1974 | Fillmore et al. | 346/75 |
| 3,805,276 | 4/1974 | Ishii | 346/140 |
| 3,825,222 | 7/1974 | Petrova | 251/149.6 |
| 3,831,727 | 8/1974 | Kruspe et al. | 197/1 R |
| 3,873,062 | 3/1975 | Johnson et al. | 251/149.6 |
| 3,896,853 | 7/1975 | Bernhard | 137/614.05 |
| 3,924,654 | 12/1975 | Buller et al. | 137/322 |
| 3,950,761 | 4/1976 | Kashio | 346/140 R |
| 3,961,337 | 6/1976 | Jung et al. | 346/140 R |
| 4,053,901 | 10/1977 | Skafvenstedt et al. | 346/140 R |
| 4,053,902 | 10/1977 | Skafvenstedt et al. | 346/140 R |
| 4,074,284 | 2/1978 | Dexter et al. | 346/140 R |
| 4,079,384 | 3/1978 | Takano et al. | 346/140 R |
| 4,084,165 | 4/1978 | Skafvenstedt et al. | 346/140 R |
| 4,114,853 | 9/1978 | Medvick | 251/149.6 |
| 4,119,034 | 10/1978 | Wax | 101/366 |
| 4,122,457 | 10/1978 | Erickson et al. | 346/75 |
| 4,126,868 | 11/1978 | Kirner | 346/140 R |
| 4,131,899 | 12/1978 | Christou | 346/140 R |
| 4,142,653 | 3/1979 | Mascia et al. | 222/207 |
| 4,149,172 | 4/1979 | Heinzl et al. | 346/140 R |
| 4,156,244 | 5/1979 | Erickson et al. | 346/140 R |
| 4,178,595 | 12/1979 | Jinnai et al. | 346/140 R |
| 4,183,031 | 1/1980 | Kyser et al. | 346/140 R |
| 4,187,511 | 2/1980 | Robinson | 346/75 |
| 4,204,215 | 5/1980 | Nakarai | 346/140 R |
| 4,234,885 | 11/1980 | Arway | 346/140 R |
| 4,253,103 | 2/1981 | Heinzl et al. | 346/140 R |
| 4,263,602 | 4/1981 | Matsumoto et al. | 346/140 R |
| 4,270,133 | 5/1981 | Shimazawa et al. | 346/140 R |
| 4,287,523 | 9/1981 | Thomas et al. | 346/140 R |
| 4,303,929 | 12/1981 | Blanck | 346/140 R |
| 4,320,407 | 3/1982 | Goldis et al. | 346/140 R |
| 4,323,907 | 4/1982 | Italiano | 346/140 R |
| 4,324,239 | 4/1982 | Gordon et al. | 128/214 R |
| 4,329,698 | 5/1982 | Smith | 346/140 R |
| 4,336,037 | 6/1982 | Goldis et al. | 346/140 R |
| 4,339,761 | 7/1982 | Matsumoto et al. | 346/75 |
| 4,340,896 | 7/1982 | Cruz-Uribe et al. | 346/140 R |
| 4,342,041 | 7/1982 | Kasugayama et al. | 346/140 R |
| 4,342,042 | 7/1982 | Cruz-Uribe et al. | 346/140 R |
| 4,345,627 | 8/1982 | Cassia | 141/18 |
| 4,357,617 | 11/1982 | Shimazawa et al. | 346/140 R |
| 4,371,004 | 2/1983 | Sysolin et al. | 137/899 |
| 4,376,283 | 3/1983 | Bower | 346/140 R |
| 4,380,772 | 4/1983 | Italiano | 346/140 R |
| 4,383,263 | 5/1983 | Ozawa et al. | 346/140 R |
| 4,394,669 | 7/1983 | Ozawa et al. | 346/140 R |
| 4,403,229 | 9/1983 | Bartek | 346/75 |
| 4,412,232 | 10/1983 | Weber et al. | 346/140 R |
| 4,413,267 | 11/1983 | Hein | 346/75 |
| 4,419,677 | 12/1983 | Kasugayama et al. | 366/140 R |
| 4,421,296 | 12/1983 | Stephens | 251/149.7 |
| 4,422,084 | 12/1983 | Saito | 346/140 R |
| 4,422,086 | 12/1983 | Miura et al. | 346/140 R |
| 4,429,320 | 1/1984 | Hattori et al. | 346/140 R |
| 4,433,341 | 2/1984 | Thomas | 346/140 R |
| 4,447,820 | 5/1984 | Terasawa | 346/140 R |
| 4,456,916 | 6/1984 | Kocot | 346/140 R |
| 4,460,904 | 7/1984 | Oszczakiewicz et al. | 364/75 |
| 4,462,037 | 7/1984 | Bangs et al. | 346/140 R |
| 4,471,364 | 9/1984 | Kocot | 346/140 R |
| 4,475,116 | 10/1984 | Sicking et al. | 346/140 R |
| 4,476,472 | 10/1984 | Aiba et al. | 346/75 |
| 4,496,959 | 1/1985 | Frerichs | 346/140 R |
| 4,496,960 | 1/1985 | Fischbeck | 346/140 R |
| 4,498,658 | 2/1985 | Mikiya | 251/149.6 |
| 4,500,895 | 2/1985 | Buck et al. | 346/140 R |
| 4,502,055 | 2/1985 | Horike et al. | 346/140 R |
| 4,502,059 | 2/1985 | Blessington | 346/140 R |
| 4,506,862 | 3/1985 | Spinosa et al. | 251/149.5 |
| 4,509,659 | 4/1985 | Cloutier et al. | 222/41 |
| 4,511,906 | 4/1985 | Hara | 346/140 R |
| 4,520,369 | 5/1985 | Shackleton | 346/75 |
| 4,527,170 | 7/1985 | Iwasaki et al. | 346/75 |
| 4,527,175 | 7/1985 | Kojima et al. | 346/140 R |
| 4,536,777 | 8/1985 | Matsumoto | 346/140 R |
| 4,541,457 | 9/1985 | Blenkush | 137/614.06 |
| 4,542,386 | 9/1985 | Delligatii et al. | 346/140 R |
| 4,542,390 | 9/1985 | Bruning et al. | 346/140 R |
| 4,555,719 | 11/1985 | Arway et al. | 346/140 R |
| 4,558,326 | 12/1985 | Kimura et al. | 346/1.1 |
| 4,568,954 | 2/1986 | Rosback | 346/140 R |
| 4,575,738 | 3/1986 | Sheufelt et al. | 346/140 R |
| 4,576,199 | 3/1986 | Svensson et al. | 137/614.04 |
| 4,586,058 | 4/1986 | Yamazaki et al. | 346/140 R |
| 4,590,494 | 5/1986 | Ichihashi et al. | 346/140 R |
| 4,591,875 | 5/1986 | McCann | 346/75 |
| 4,593,294 | 6/1986 | Parisi | 346/140 R |
| 4,599,625 | 7/1986 | Terasawa et al. | 346/140 R |
| 4,600,927 | 7/1986 | Sugitani | 346/1.1 |
| 4,602,662 | 7/1986 | Eremity et al. | 141/198 |
| 4,604,633 | 8/1986 | Kimura et al. | 346/140 R |
| 4,607,261 | 8/1986 | McCann et al. | 346/75 |
| 4,609,925 | 9/1986 | Nozu et al. | 346/1.1 |
| 4,610,202 | 9/1986 | Ebinuma et al. | 101/384 |
| 4,623,905 | 11/1986 | Ichibashi et al. | 346/140 R |
| 4,628,332 | 12/1986 | Matsumoto | 346/140 R |
| 4,628,333 | 12/1986 | Terasawa | 346/140 R |
| 4,630,072 | 12/1986 | Scardovi et al. | 346/140 R |
| 4,630,758 | 12/1986 | Mutoh | 222/189 |
| 4,636,814 | 1/1987 | Terasawa | 346/140 R |
| 4,639,738 | 1/1987 | Young et al. | 346/75 |
| 4,658,272 | 4/1987 | Toganoh et al. | 346/140 R |
| 4,658,273 | 4/1987 | Yuki et al. | 346/140 R |
| 4,672,993 | 6/1987 | Bilak | 137/322 |
| 4,673,955 | 6/1987 | Ameyama et al. | 346/140 R |
| 4,677,447 | 6/1987 | Nielsen | 346/140 R |
| 4,680,696 | 7/1987 | Ebinuma et al. | 346/75 |
| 4,683,905 | 8/1987 | Vigneau et al. | 137/329.1 |
| 4,684,962 | 8/1987 | Hirosawa et al. | 346/140 R |
| 4,689,642 | 8/1987 | Sugitani | 346/140 R |
| 4,694,307 | 9/1987 | Toganch et al. | 346/140 R |
| 4,695,824 | 9/1987 | Tazaki | 346/140 R |
| 4,699,356 | 10/1987 | Hargrove et al. | 251/149.6 |
| 4,700,202 | 10/1987 | Kuranishi et al. | 346/140 R |
| 4,700,205 | 10/1987 | Rich et al. | 346/140 R |
| 4,700,744 | 10/1987 | Rutter et al. | 137/614.04 |
| 4,709,725 | 12/1987 | Morrison | 137/614.04 |
| 4,714,937 | 12/1987 | Kaplinsky | 346/140 R |
| 4,719,475 | 1/1988 | Kiyohara et al. | 346/140 R |
| 4,734,711 | 3/1988 | Piatt et al. | 346/75 |
| 4,736,774 | 4/1988 | Vonasek | 137/883 |
| 4,737,801 | 4/1988 | Ichihashi et al. | 346/140 R |

| | | | |
|---|---|---|---|
| 4,739,347 | 4/1988 | Ishikawa et al. | 346/140 R |
| 4,739,847 | 4/1988 | Terasawa | 177/140 |
| 4,757,331 | 7/1988 | Mizusawa | 346/140 R |
| 4,760,409 | 7/1988 | Kiyohara et al. | 346/140 R |
| 4,765,657 | 8/1988 | Cruse | 285/91 |
| 4,775,871 | 10/1988 | Abe et al. | 346/140 R |
| 4,777,497 | 10/1988 | Nozu et al. | 346/140 R |
| 4,785,314 | 11/1988 | Terasawa et al. | 346/140 R |
| 4,788,556 | 11/1988 | Hoisington et al. | 346/140 R |
| 4,811,035 | 3/1989 | Huliba et al. | 346/75 |
| 4,814,786 | 3/1989 | Hoisington et al. | 346/1.1 |
| 4,814,794 | 3/1989 | Sato | 346/140 R |
| 4,825,228 | 4/1989 | Gloeckler et al. | 346/1.1 |
| 4,826,052 | 5/1989 | Micallef | 222/321 |
| 4,831,389 | 5/1989 | Chan | 346/140 R |
| 4,844,408 | 7/1989 | Beaston | 251/149.8 |
| 4,849,773 | 7/1989 | Owatari | 346/140 R |
| 4,853,708 | 8/1989 | Walters | 346/75 |
| 4,881,569 | 11/1989 | Fournier et al. | 137/360 |
| 4,888,602 | 12/1989 | Watanabe et al. | 346/134 |
| 4,896,171 | 1/1990 | Ito | 346/140 R |
| 4,898,209 | 2/1990 | Zbed | 137/614.04 |
| 4,907,019 | 3/1990 | Stephens | 346/140 R |
| 4,910,529 | 3/1990 | Regnault | 346/75 |
| 4,911,203 | 3/1990 | Garms | 137/614.04 |
| 4,920,360 | 4/1990 | Terasawa et al. | 346/140 R |
| 4,926,196 | 5/1990 | Mizoguchi et al. | 346/140 R |
| 4,928,126 | 5/1990 | Asai | 346/140 R |
| 4,929,109 | 5/1990 | Ikenaga | 101/134 |
| 4,931,044 | 6/1990 | Beiter | 604/248 |
| 4,931,814 | 6/1990 | Yoshimura | 346/140 R |
| 4,934,655 | 6/1990 | Blenkush et al. | 251/149.1 |
| 4,935,751 | 6/1990 | Hamlin | 346/140 R |
| 4,937,598 | 6/1990 | Hine et al. | 346/140 R |
| 4,940,995 | 7/1990 | Hine et al. | 346/140 R |
| 4,940,997 | 7/1990 | Hamlin et al. | 346/140 R |
| 4,942,901 | 7/1990 | Vescovini | 137/614.06 |
| 4,953,756 | 9/1990 | Breault et al. | 222/309 |
| 4,957,483 | 9/1990 | Gonser et al. | 604/30 |
| 4,958,754 | 9/1990 | Dennis | 222/383 |
| 4,959,667 | 9/1990 | Kaplisnky | 346/140 R |
| 4,961,082 | 10/1990 | Hoisington et al. | 346/104 R |
| 4,967,207 | 10/1990 | Ruder | 346/140 R |
| 4,968,998 | 11/1990 | Allen | 346/140 R |
| 4,970,533 | 11/1990 | Saito et al. | 346/140 R |
| 4,973,993 | 11/1990 | Allen | 346/140 R |
| 4,977,413 | 12/1990 | Yamanaka et al. | 346/140 R |
| 4,987,429 | 1/1991 | Finley et al. | 346/157 |
| 4,991,820 | 2/1991 | Kohn et al. | 251/149.5 |
| 4,992,802 | 2/1991 | Dion et al. | 346/1.1 |
| 4,995,940 | 2/1991 | Hine et al. | 156/629 |
| 4,999,652 | 3/1991 | Chan | 346/140 R |
| 5,002,254 | 3/1991 | Belisaire et al. | 251/149.9 |
| 5,008,688 | 4/1991 | Ebinuma et al. | 346/140 R |
| 5,025,270 | 6/1991 | Umezawa | 346/140 R |
| 5,026,024 | 6/1991 | Ito | 251/149.5 |
| 5,030,973 | 7/1991 | Nonoyama et al. | 346/140 R |
| 5,043,746 | 8/1991 | Abe | 346/140 R |
| 5,053,787 | 10/1991 | Terasawa et al. | 346/1.1 |
| 5,070,347 | 12/1991 | Yuki et al. | 346/140 R |
| 5,074,524 | 12/1991 | Wade | 251/149.6 |
| 5,119,115 | 6/1992 | Buat et al. | 346/140 R |
| 5,126,767 | 6/1992 | Asai | 346/140 R |
| 5,136,305 | 8/1992 | Ims | 346/1.1 |
| 5,136,309 | 8/1992 | Iida et al. | 346/140 R |
| 5,138,332 | 8/1992 | Carlotta | 346/140 R |
| 5,153,612 | 10/1992 | Dunn et al. | 346/140 R |
| 5,155,502 | 10/1992 | Kimura et al. | 346/140 R |
| 5,159,348 | 10/1992 | Dietl et al. | 346/1.1 |
| 5,182,581 | 1/1993 | Kashimura et al. | 346/140 R |
| 5,187,498 | 2/1993 | Burger | 346/140 R |
| 5,189,438 | 2/1993 | Hine et al. | 346/1.1 |
| 5,199,470 | 4/1993 | Goldman | 141/1 |
| 5,206,668 | 4/1993 | Lo et al. | 346/140 R |
| 5,215,231 | 6/1993 | Paczonay | 222/610 |
| 5,216,452 | 6/1993 | Suzuki | 346/140 R |
| 5,220,345 | 6/1993 | Hirosawa | 346/1.1 |
| 5,221,935 | 6/1993 | Uzita | 346/140 R |
| 5,221,936 | 6/1993 | Saito et al. | 346/140 R |
| 5,245,915 | 9/1993 | Ford | 99/289 R |
| 5,255,827 | 10/1993 | Breault et al. | 222/309 |
| 5,270,739 | 12/1993 | Kitani et al. | 346/140 R |
| 5,280,300 | 1/1994 | Fong et al. | 346/1.1 |
| 5,283,593 | 2/1994 | Wehl | 346/140 R |
| 5,289,212 | 2/1994 | Carlotta | 346/140 R |
| 5,293,913 | 3/1994 | Preszler | 141/367 |
| 5,305,920 | 4/1994 | Reiboldt et al. | 222/95 |
| 5,306,125 | 4/1994 | Weag | 417/472 |
| 5,307,091 | 4/1994 | DeCoste, Jr. | 346/140 R |
| 5,311,214 | 5/1994 | Hirasawa et al. | 346/1.1 |
| 5,320,326 | 6/1994 | Ju et al. | 251/149.6 |
| 5,328,055 | 7/1994 | Battle | 222/83.5 |
| 5,329,294 | 7/1994 | Ontawar et al. | 397/87 |
| 5,331,339 | 7/1994 | Takahashi | 349/89 |
| 5,337,925 | 8/1994 | Ferrara, Jr. | 222/214 |
| 5,341,161 | 8/1994 | Yamakawa et al. | 347/87 |
| 5,341,162 | 8/1994 | Hermanson et al. | 347/92 |
| 5,343,226 | 8/1994 | Niedermeyeyr et al. | 347/85 |
| 5,348,192 | 9/1994 | Sardynski et al. | 222/129.1 |
| 5,351,073 | 9/1994 | Kageyama et al. | 347/87 |
| 5,359,353 | 10/1994 | Hunt et al. | 347/86 |
| 5,359,356 | 10/1994 | Ecklund | 347/86 |
| 5,359,357 | 10/1994 | Takaji et al. | 347/49 |
| 5,365,260 | 11/1994 | Kitani et al. | 347/87 |
| 5,365,262 | 11/1994 | Hattori et al. | 347/87 |
| 5,368,070 | 11/1994 | Bosley | 137/614.04 |
| 5,369,429 | 11/1994 | Erickson | 347/7 |
| 5,372,306 | 12/1994 | Yianilos | 239/201 |
| 5,381,172 | 1/1995 | Ujita et al. | 347/86 |
| 5,385,331 | 1/1995 | Allread et al. | 251/149.1 |
| 5,390,702 | 2/1995 | Smith, III | 137/614.04 |
| 5,394,177 | 2/1995 | McCann et al. | 347/7 |
| 5,394,181 | 2/1995 | Braun | 347/92 |
| 5,396,268 | 3/1995 | Mader | 347/7 |
| 5,400,066 | 3/1995 | Matsumoto | 347/86 |
| 5,400,573 | 3/1995 | Crystal et al. | 53/468 |
| 5,402,982 | 4/1995 | Atkinson et al. | 251/149.1 |
| 5,406,320 | 4/1995 | Durst et al. | 347/86 |
| 5,408,256 | 4/1995 | Keen et al. | 347/87 |
| 5,426,459 | 6/1995 | Kaplinsky | 347/87 |
| 5,546,109 | 8/1996 | Nakano | 347/92 |
| 5,646,666 | 7/1997 | Cowger et al. | 347/87 |
| 5,677,718 | 10/1997 | Crawford et al. | 347/92 |
| 5,701,148 | 12/1997 | Moynihan et al. | 347/92 |

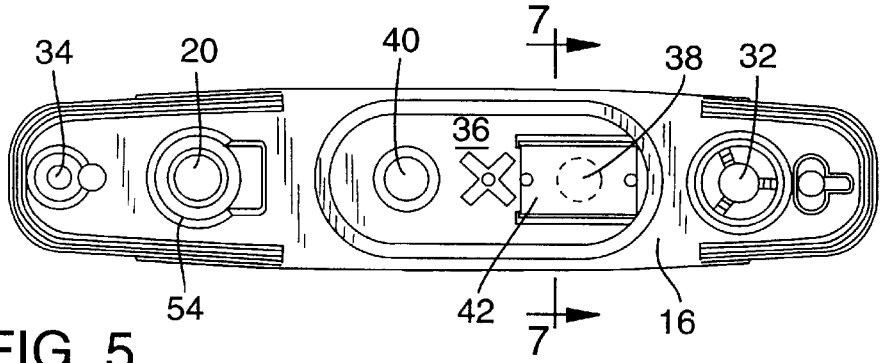
FIG. 5
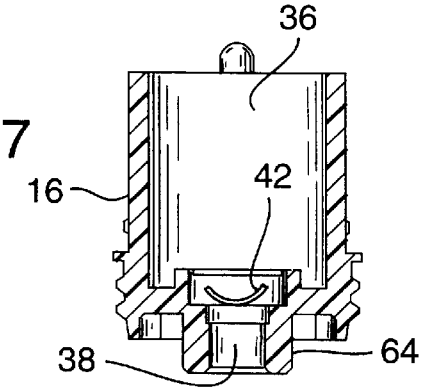
FIG. 7
FIG. 6
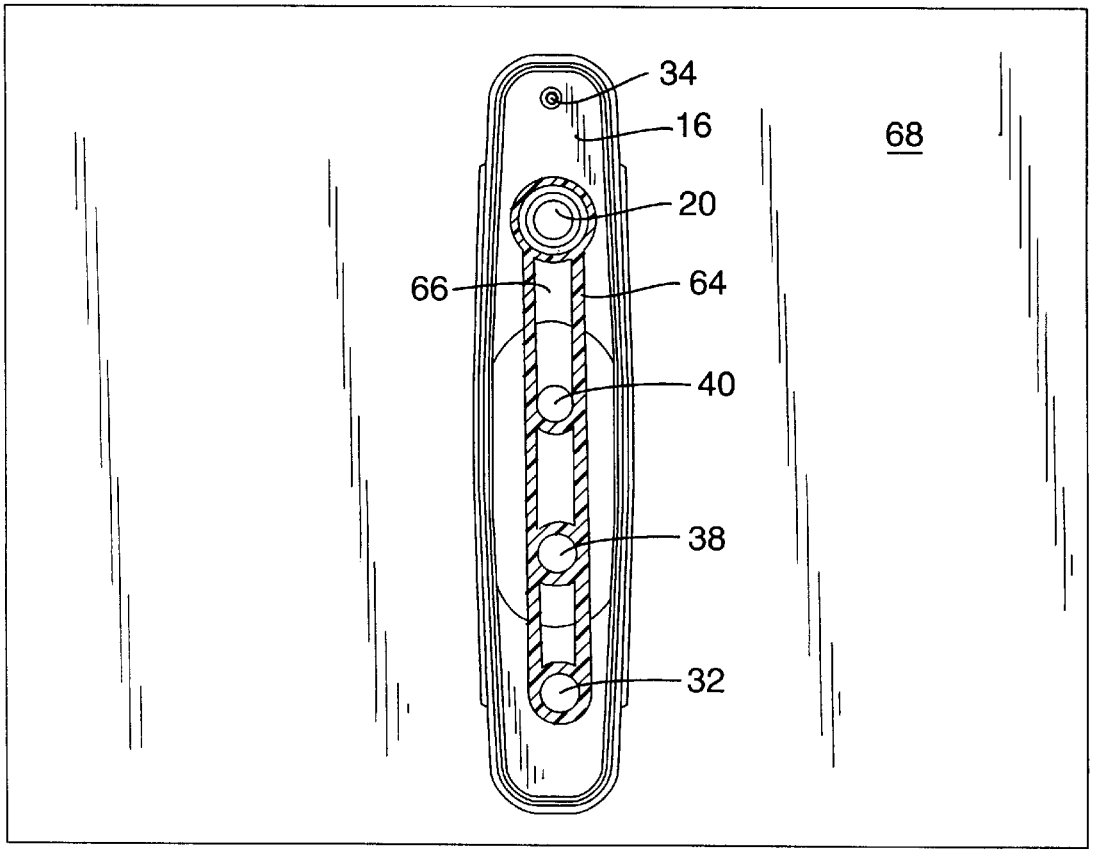

AIR PURGE SYSTEM FOR AN INK-JET PRINTER

BACKGROUND OF THE INVENTION

1. Field of the Invention

The present invention relates to an ink printing system for an ink-jet printer and, more particularly, to an air purge system for such a printer.

2. General Discussion of the Background

Ink-jet printers have become established as reliable and efficient printing devices. Typically, an ink-jet printer utilizes a print head mounted on a carriage which is moved relative to a printing surface. A control system activates ink jets on the moving print head at the appropriate locations causing the print head to eject, or jet, ink drops onto the printing surface to form desired images and characters.

One type of ink jet printer uses a method known as drop-on-demand printing. In this technique, ink is held in the pen at below atmospheric pressure and is ejected by a drop generator, one drop at a time, on demand. Ejection is achieved by a thin film resistor that vaporizes a small portion of ink, or a piezoelectric element that abruptly compresses a volume of ink to produce a pressure wave that displaces ink from a nozzle. As an ink droplet is dispelled, capillary action draws new ink into the drop generator.

The drop-on demand techniques require that under quiescent conditions the pressure in the ink reservoir be below ambient pressure so that ink is retained in the pen until it is to be ejected. The amount of this "underpressure" must be regulated. If the underpressure is too small, or if the reservoir pressure is positive, ink tends to escape through the drop generators. If the underpressure is too large, air may be sucked in through the drop generators and interfere with the capillary action that supplies ink to the print head.

Many drop-on-demand ink-jet printers use a disposable ink pen that can be mounted to the carriage. The disposable ink pen typically includes a print head, a reservoir for containing an ink supply, and a pressure regulating mechanism to maintain the ink supply at an appropriate pressure to avoid ink drooling or air ingestion. When the ink supply is exhausted, the entire ink pen is replaced.

An example of a drop-on-demand system is the Hewlett-Packard Zaphod Pen disclosed in U.S. patent application Ser. No. 08/331,453 filed Oct. 31, 1994. In this system, ink is drawn from a stationary reservoir and pressurized in a pump to propel the ink through a supply tube to a first ink containment chamber in an ink jet pen mounted on a movable printer carriage. A regulator mechanism within the pen body intermittently opens to supply ink to a second ink containment chamber in the pen that communicates with the print head orifice. The regulator maintains a sufficient back pressure on the ink to prevent it from drooling out of the print head.

The pressure regulating mechanism carried by the ink pen increases the size of the pen body. The increased size of the pen body in turn requires a greater carriage mass and cost, which discourages production of more compact and portable ink jet printers. The print head and pressure regulating mechanisms also often have a useful life that is far longer than the supply of ink in the reservoir. Thus, when the ink pen is discarded, the print head and pressure regulating mechanisms are discarded too, even though they may have a significant period of usable life remaining. Moreover, in multiple color ink pens, it is unlikely that all of the ink reservoirs will be depleted at the same time. Thus, the discarded ink pen will likely contain unused ink as well as a fully functional print head and pressure regulating mechanism. Disposal of useful parts and remaining ink results in an increased cost to the user and an inefficient use of resources.

To address problems associated with disposable ink pens, some ink-jet printers have permanent, refillable remote ink supplies that are not mounted to the carriage. Such ink supplies, because they are stationary within the printer, are not subject to all of the size constraints of an ink supply that is moved with the carriage. Ink is supplied from the reservoir to the print head through a supply line which trails from the print head. Alternatively, the print head can include a small ink reservoir that is periodically replenished by moving the print head to a filling station at the stationary, built-in reservoir.

However, such built-in remote reservoirs are frequently difficult and messy to refill. In addition, because they are never replaced, built-in ink reservoirs tend to collect particles and contaminants that can adversely affect printer performance.

In view of these problems, some printers use replaceable remote reservoirs that are not located on the carriage and do not move with the print head during printing. Replaceable reservoirs are often plastic bags filled with ink. The bag is provided with a septum that can be punctured by a hollow needle, for coupling it to the printer and allowing ink to flow from the bag to the print head. The bag may be squeezed or pressurized in some other manner to cause ink to flow from the reservoir. If the bag bursts or leaks while under pressure, ink may be showered on the printer or operator.

All of these systems are plagued by unwanted air that enters the ink reservoir, supply lines and pen in a variety of ways. Air may be introduced into the system by empty supply lines prior to printer initialization, or by "air gulping" through fluid interconnects during start-up or operation. Air also diffuses through the walls of system components (such as pen body walls or tubes), or is evolved as gas when ink is heated at the printing die. Air in the ink supply system can cause "dry firing" of the drop generator, which is harmful to the printhead. Alternatively, gas bubbles in supply lines can interfere with hydraulic flow through supply lines or capillary movement of ink through small orifices at the printhead.

Many different approaches have been tried to eliminate unwanted gas in the ink supply flow path. Some ink jet pens (such as the Hewlett-Packard Zaphod pen) are designed with empty internal space to "warehouse" air over the life of the pen. The additional space required for warehousing air in the movable pen increases the size of the printer to accommodate the bulky pen over its path of movement. The Canon BJ300 printer uses an air separator between an ink reservoir and pen body to remove air from the ink supply flow path, but this solution requires complex additional components that increase the cost and size of the printer.

SUMMARY OF THE INVENTION

Accordingly, it is an object of the present invention to provide an ink supply for an ink jet printer that reliably provides an uninterrupted supply of ink for a print head, and addresses the problem of air in the ink flow pathway.

It is a further object of the invention to provide an ink supply system that is compact and which can be simply and inexpensively manufactured and easily used.

It is a further object of the invention to provide a more cost-effective and environmentally compatible ink supply that limits waste and more efficiently uses the ink and other components of the ink supply.

It is a further particular object of the invention to provide a compact and economical ink jet printer that is able to recover or maintain print quality even if air is introduced in the ink supply flow path.

These objects are achieved by providing an ink jet pen body housing having a containment chamber for holding ink. A supply of ink remote from the ink jet pen body housing is connected to the pen body by a supply line through which ink moves directly to the containment chamber, without first being admitted to a pressure regulating chamber. The ink jet pen is primed or initialized by introducing ink under positive pressure from the remote supply of ink into the supply line to fill the supply line and pen body, which removes air from the ink supply flow path. A back pressure is maintained on the ink in the containment chamber by the remote supply of ink, to inhibit drooling from the printhead. A pressure regulator in the pen body is not necessary.

In particular embodiments, a check valve releases air from the ink flow path as that path fills with ink. Air may also be periodically purged from the ink flow path by sequentially introducing ink under positive pressure from the remote reservoir into the supply line and containment chamber. Periodic purging may occur at preselected intervals of time, or may be initiated in response to a signal that is given when a pneumatic occlusion of the ink flow path is detected. Alternatively, an operator may initiate air purging in response to a deterioration in print quality.

An ink supply in accordance with one aspect of the present invention has a main reservoir for holding a supply of ink. The main reservoir, which is typically maintained at about ambient pressure, is coupled to a variable volume pump via a one-way check valve which allows the flow of ink from the reservoir to the pump and prevents the flow of ink from the pump to the reservoir. The pump is coupled to a fluid outlet that is normally closed to prevent the flow of ink. However, when the ink supply is installed in a printer, the fluid outlet opens to establish a fluid connection between the pump and the printer.

In a particular embodiment, the pump has a variable volume pump chamber. When the volume of the pump chamber is increased, ink is drawn from the reservoir through the one-way check valve and into the pump chamber. When the volume of the pump chamber is subsequently decreased, ink is forced from the pump chamber through the fluid outlet, supply line and pen body to supply the print head. Ink remains in the pump chamber after the supply line and pen body are filled, so that ink continues to be drawn hydraulically through the supply line into the pen body as ink is expelled from the printhead.

Other objects and aspects of the invention will become apparent to those skilled in the art from the detailed description of the invention which is presented by way of example and not as a limitation of the present invention.

BRIEF DESCRIPTION OF THE DRAWINGS

FIG. 5 is a bottom view of the chassis of an ink supply in accordance with a preferred embodiment of the present invention.

FIG. 6 is a top view of the chassis of FIG. 5.

FIG. 7 is a cross sectional view taken along line 7—7 of the inverted chassis shown in FIG. 5.

DESCRIPTION OF THE ILLUSTRATED EMBODIMENT

Figure 1:
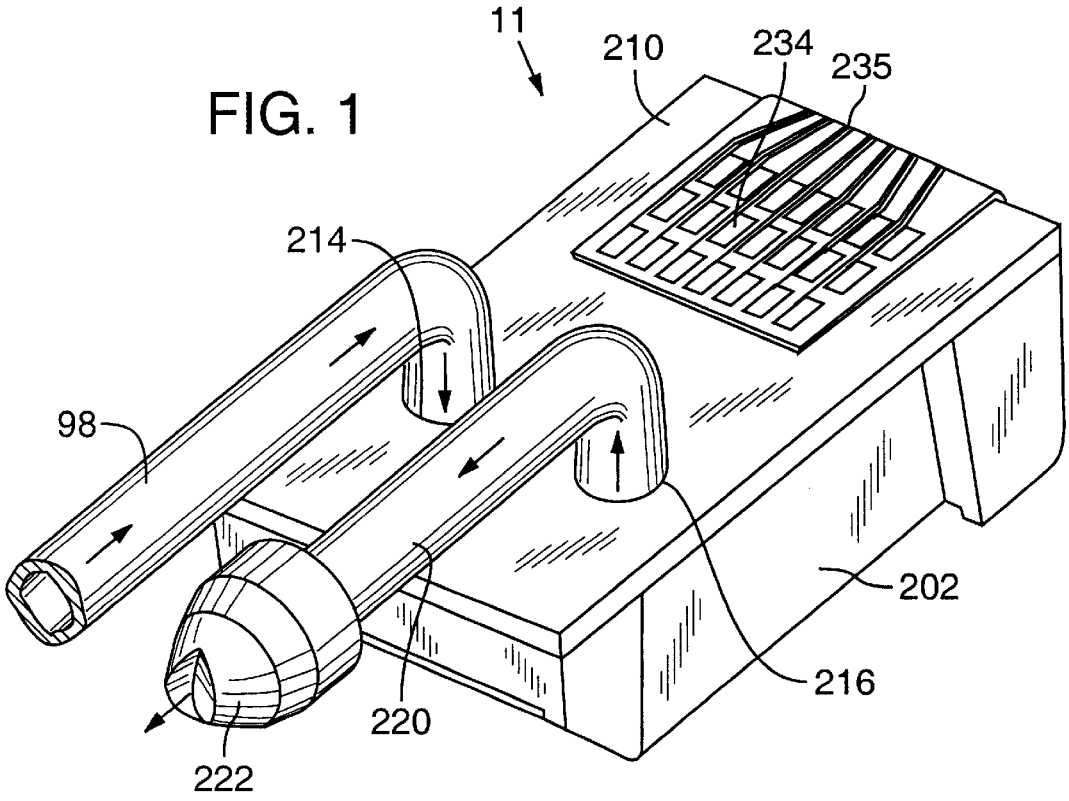
FIG. 1 is a top perspective view of an ink jet pen body made in accordance with the present invention.
Figure 3:
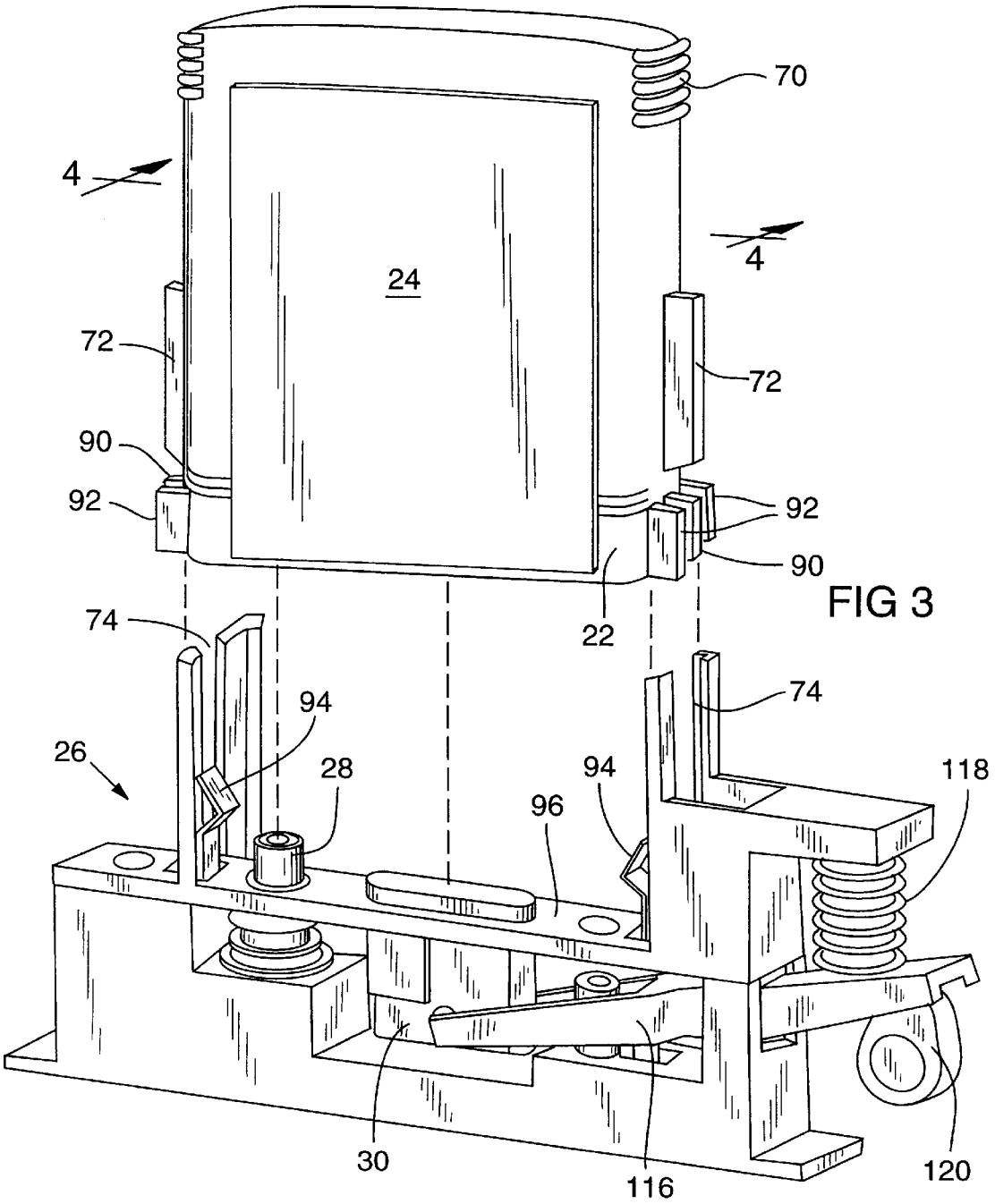
FIG. 3 shows a preferred embodiment of an ink supply that may be used to supply ink to the pen body of FIG. 1.
Figure 4:
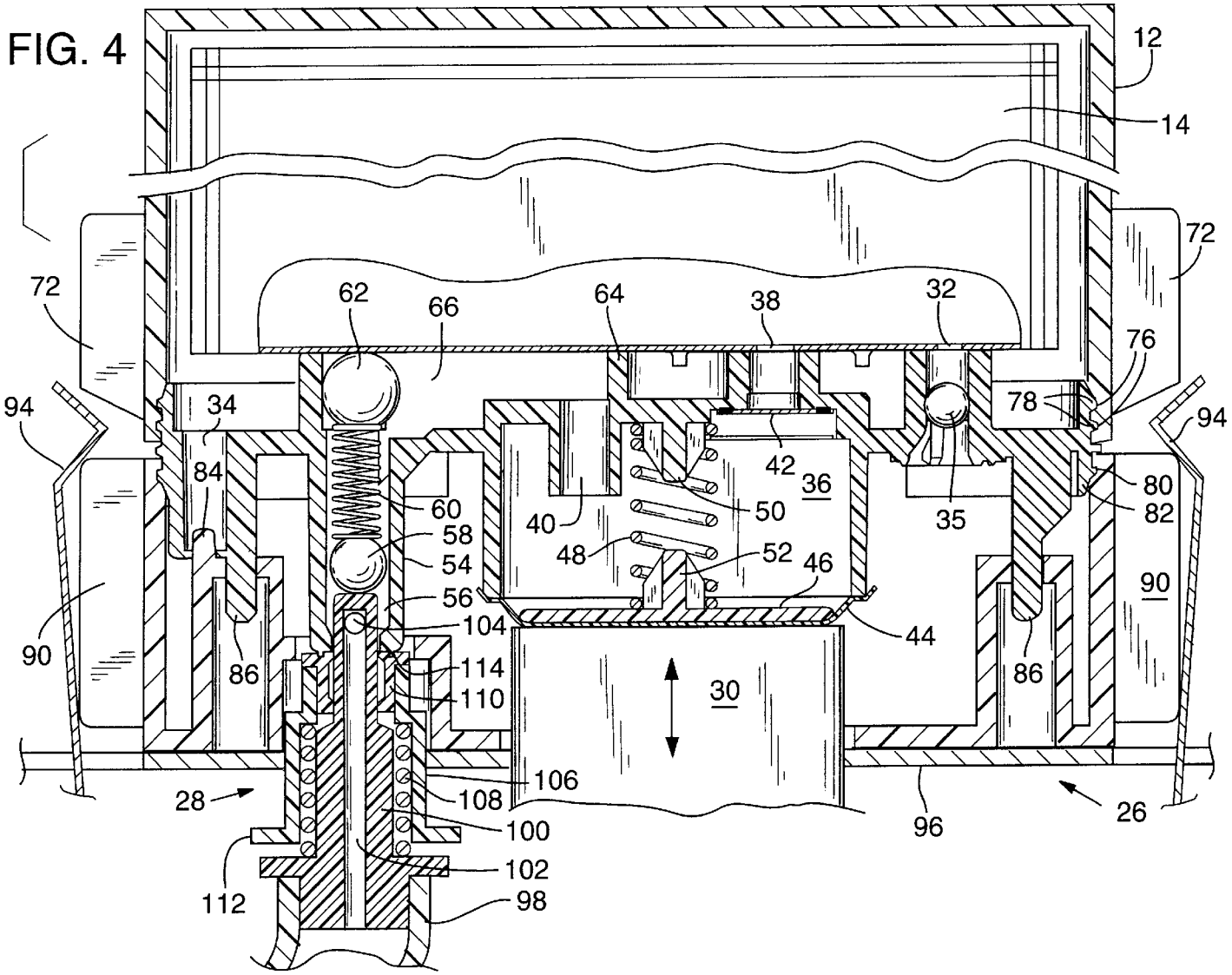
FIG. 4 is a cross sectional view taken along line 4—4 in FIG. 3, with the ink supply installed in the printer.

The present apparatus for priming an ink jet pen and removing air from its ink flow path includes, in a preferred embodiment of the present invention, an ink supply 10 (FIG. 3) that provides ink to an ink jet pen body 11 (FIGS. 1 and 2) through a supply line 98 (FIGS. 1 and 4). The ink supply 10 has a hard protective shell 12 which contains a flexible reservoir 14 (FIG. 4) for containing ink. The shell 12 is attached to a chassis 16 (FIGS. 4–6) which houses a pump 18 (FIG. 4) and a fluid outlet 20 (FIGS. 4–6). A protective cap 22 (FIG. 3) is attached to the chassis 16 and a label 24 is glued to the outside of the ink supply 10 to secure the shell 12, chassis 16, and cap 22 firmly together. The cap 22 is provided with apertures which allow access to the pump and the fluid outlet.

As illustrated in FIGS. 3 and 4, ink supply 10 can be removably inserted into a docking bay 26 within an ink-jet printer. When the ink supply is inserted into the printer, a fluid inlet 28 (FIG. 3) in docking bay 26 couples with fluid outlet 20 of the chassis (FIG. 5) to allow ink to flow from ink supply 10 to the printer. A pump actuator 30 in docking bay 26 engages pump 18 (FIG. 4). Reciprocation of actuator 30 causes pump 18 to draw ink from reservoir 14, and expel the ink under pressure through fluid outlet 20, fluid inlet 28, and to the printer.

Chassis 16, as seen in FIGS. 4 and 5, is provided with a fill port 32 at one end and an exhaust port 34 at the other end. Ink can be added to the ink supply through fill port 32 while air displaced by the added ink is exhausted through exhaust port 34. After the ink supply is filled, fill port 32 is sealed with a ball 35 press fit into the fill port.

Pump 18 (FIG. 4) includes a variable volume chamber 36 on the bottom of chassis 16. As described in more detail below, chamber 36 serves as a variable volume pump chamber that can be pressurized by advancement of a reciprocable member to supply ink to the printer. The top of chamber 36 is provided with an inlet port 38 through which ink may enter chamber 36 from reservoir 14. An outlet port 40 through which ink may be expelled from chamber 36 is also provided.

A one-way flapper valve 42 (FIGS. 4 and 7) is located at the bottom of inlet port 38 and serves to limit the return of ink from chamber 36 to reservoir 14. Flapper valve 42 is a rectangular piece of flexible material. When the pressure within the chamber drops below that in the reservoir, the sides of valve 42 each flex, as seen in FIG. 7, to allow the flow of ink through inlet port 38 and into chamber 36.

In the illustrated embodiment flapper valve 42 is made of a two ply material. The top ply is a layer of low density polyethylene 0.0015 inches thick. The bottom ply is a layer of polyethylene terephthalate (PET) 0.0005 inches thick. The illustrated flapper valve 42 is approximately 5.5 millimeters wide and 8.7 millimeters long. Of course, in other embodiments, other materials or other types or sizes of valves may be used.

The bottom of chamber 36 is covered with a flexible diaphragm 44, shown best in FIG. 4. Diaphragm 44 is slightly larger than the bottom face of chamber 36 and is sealed around the edge thereof. The excess material in the oversized diaphragm allows the diaphragm to flex up and down to vary the volume of the chamber. In the illustrated ink supply, the displacement of the diaphragm allows the volume of chamber 36 to be varied by about 0.7 cubic centimeters. The fully expanded volume of the illustrated chamber 36 is between about 2.2 and 2.5 cubic centimeters.

Within chamber 36, a pressure plate 46 is positioned adjacent diaphragm 44. A pump spring 48, made of stainless steel in the illustrated embodiment, biases pressure plate 46 against diaphragm 44 to urge the diaphragm outward and expand the volume of chamber 36. A top end of pump spring 48 is received on a spike 50 formed at the top of chamber 36 and the other end of the pump spring 48 is received on a spike 52 formed on pressure plate 46 to retain pump spring 48 in position. Pressure plate 46 in the illustrated embodiment is molded of high density polyethylene.

A hollow cylindrical boss 54 (FIG. 4) extends downward from chassis 16 to form the housing of fluid outlet 20. A bore 56 of hollow boss 54 has a narrow throat at its lower end. A sealing ball 58, made of stainless steel in the illustrated embodiment, is positioned within bore 56. Sealing ball 58 is sized such that it can move freely within bore 56, but cannot pass through the narrow throat. A sealing spring 60 is positioned within bore 56 to urge sealing ball 58 against the narrow throat to form a seal and prevent the flow of ink through the fluid outlet when the supply tube is not connected to the chassis. A stainless steel retaining ball 62 is press fit into the top of the bore to retain the sealing spring 60 in place. Bore 56 is configured to allow the free flow of ink past the retaining ball and into the bore.

As illustrated in FIGS. 6 and 7, a raised manifold 64 is formed on the top of chassis 16. Manifold 64 forms a cylindrical boss around the top of fill port 32 and a similar boss around the top of inlet port 38 so that each of these ports is isolated. Manifold 64 extends around the base of fluid outlet 20 and outlet port 40 to form an open-topped conduit 66 joining the two outlets.

As shown in FIG. 4, the flexible ink reservoir 14 is attached to the top of manifold 64 so as to form a top cover for conduit 66. In the illustrated embodiment, this is accomplished by heat staking a rectangular plastic sheet 68, seen in FIG. 6, to the top surface of manifold 64 to enclose conduit 66. The areas that are heat staked are shown by cross hatching in FIG. 6. In the illustrated embodiment, the chassis is molded of high density polyethylene and the plastic sheet is low density polyethylene that is 0.002 inches thick. These two materials can be easily heat staked using conventional methods and are also readily recyclable.

After plastic sheet 68 is attached to chassis 16, the sheet can be folded and sealed around its two sides and top to form the flexible ink reservoir 14. Heat staking can be used to seal the perimeter of the plastic sheet.

The plastic sheet over port 32 and over inlet port 38 can be punctured, pierced, or otherwise removed so as not to block the flow of ink through these ports. Reservoir 14 is enclosed within protective shell 12, made of clarified polypropylene. A thickness of about one millimeter has been found to provide robust protection and to prevent unacceptable water loss from the ink. However, the material and thickness of the shell may vary in other embodiments.

As illustrated in FIG. 3, the top of shell 12 has a series of raised ribs 70 to facilitate gripping of shell 12 as it is inserted or withdrawn from docking bay 26. A vertical rib 72 projects laterally from each side of shell 12. Each rib 72 can be received within a slot 74 in the docking bay to provide lateral support and stability to the ink supply when it is positioned within the printer. The bottom of shell 12 is provided with two circumferential grooves 76 (FIG. 4) which engage two circumferential ribs 78 formed on chassis 16 to attach shell 12 to chassis 16.

The attachment between the shell and the chassis should, preferably, be snug enough to prevent accidental separation of the chassis from the shell and to resist the flow of ink from the shell should the flexible reservoir develop a leak. However, it is also desirable that the attachment allow the slow ingress of air into the shell as ink is depleted from reservoir 14 to maintain the pressure inside the shell generally the same as the ambient pressure. Otherwise, too great a negative pressure may develop inside the shell and inhibit the flow of ink from the reservoir. The ingress of air should be limited, however, in order to maintain a high humidity within the shell and minimize water loss from the ink.

To fill the ink supply, ink can be injected through fill port 32. As it is filled, flexible reservoir 14 expands to substantially fill the shell 12. As ink is being introduced into the reservoir, sealing ball 58 can be depressed to open the fluid outlet and a partial vacuum can be applied to the fluid outlet 20. The partial vacuum at the fluid outlet causes ink from reservoir 14 to fill chamber 36, conduit 66, and the bore of cylindrical boss 54 such that little, if any, air remains in contact with the ink. The partial vacuum applied to the fluid outlet also speeds the filling process. To further facilitate the rapid filling of the reservoir, exhaust port 34 is provided to allow the escape of air from the shell as the reservoir expands. Once the ink supply is filled, ball 35 is press fit into the fill port to prevent the escape of ink or the entry of air.

Of course, there are a variety of other ways which might also be used to fill the present ink supply. In some instances, it may be desirable to flush the entire ink supply with carbon dioxide prior to filling it with ink. In this way, any gas trapped within the ink supply during the filling process will be carbon dioxide, not air. This may be preferable because carbon dioxide may dissolve in some inks while air may not. In general, it is preferable to remove as much gas from the ink supply as possible so that bubbles and the like do not enter the print head or the supply tube.

The protective cap 22 is placed on the ink supply after the reservoir is filled. As seen in FIG. 4, the protective cap is provided with a groove 80 which receives a rib 82 on the chassis to attach the cap to the chassis. The cap carries a lug 84 which plugs the exhaust port 34 to limit the flow of air into the chassis and reduce water loss from the ink. A stud 86 extends from each end of chassis 16 and is received within an aperture in the cap 22 to aid in aligning the cap and to strengthen the union between the cap and chassis. It may be desirable, in some applications, to swage the ends of the studs to more firmly fix the cap to the chassis.

As illustrated in FIGS. 3 and 4, the docking bay 26 has two spring clips 94 that engage the ink supply 10 to hold it firmly in place against the base plate 96. The spring clips engage the tops of ribs 90 and keys 92 on the cap 22.

Docking station 26 includes a fluid inlet 28 (FIG. 3) coupled to a flexible trailing tube or supply line 98 (FIG. 4) that supplies ink to ink jet pen body 11. Fluid inlet 28 has a quick connect and disconnect mechanism 99 that minimizes introduction of air into the ink supply during connection/disconnection of supply line 98 to the ink supply. Mechanism 99 has an open tip that enters outlet 20 and displaces sealing ball 58 to establish fluid communication between outlet 20 and supply line 98.

Pump 18 of the illustrated embodiment is actuated by pressing diaphragm 44 inward to decrease the volume and increase the pressure within chamber 36. As the flapper valve 42 limits the escape of ink back into the reservoir 14, ink forced from chamber 36 exits through outlet port 40 and conduit 66 to the fluid outlet. When diaphragm 44 is released, pump spring 48 biases pressure plate 46 and diaphragm 44 outward, expanding the volume and decreasing the pressure within chamber 36. The decreased pressure within chamber 36 allows flapper valve 42 to open and draws ink from reservoir 14 into chamber 36. The check valve at the print head, the flow resistance within the trailing tube, or both will limit ink from returning to chamber 36 through conduit 66. Alternatively, a check valve may be provided at the outlet port, or at some other location, to prevent the return of ink through the outlet port and into the chamber.

Docking bay 26 is provided with an actuator 30 (FIG. 3) for actuating pump 18. When the ink supply is installed within docking bay 26, actuator 30 can be pressed into contact with diaphragm 44 to pressurize chamber 36. Actuator 30 is pivotably connected to one end of a lever 116. The other end of lever 116 is biased downward by a compression spring 118. In this manner, the force of compression spring 118 urges actuator 30 upward against diaphragm 44 to increase pressure within chamber 36 and urge ink from ink supply and into the printer. In the illustrated embodiment, the compression spring is chosen so as to create a pressure of about 1.5 pounds per square inch within the chamber. Of course, the desired pressure may vary depending on the requirements of a particular printer.

When the volume of chamber 36 approaches its minimum, as indicated by the height of actuator 30, a cam 120 is rotated to overcome the force of the compression spring 118 and pivot actuator 30 to its lowermost position. With the force from actuator 30 removed, pump spring 48 urges diaphragm 44 outward to increase the volume of chamber 36 and draw ink into chamber 36 from reservoir 14. Once chamber 36 has expanded, cam 120 may be rotated away from the position shown in FIG. 3 to allow compression spring 118 to again expand and urge the actuator 30 against the diaphragm 44 to subsequently pressurize the pump chamber 36.

In some embodiments it may be desirable to rotate cam 120 to depress actuator 30 and retract diaphragm 44 from chamber 36, thereby reducing the positive pressure in the chamber when the printer is printing. Alternatively, the cam can be provided with an intermediate lobe which relieves some, but not all, of the positive pressure when the printer is in a standby mode.

By monitoring the position of the actuator 30, it is also possible to accurately detect when the ink supply is nearly empty and generate and out of ink warning. This can greatly extend the life of the print head by preventing "dry" firing of the ink jets. In particular, when the ink from reservoir 14 has been exhausted, a back pressure of a preselected level will be created within the reservoir that prevents chamber 36 from fully expanding when the chamber is depressurized. This can be detected by monitoring the position of actuator 30 when the system is repressurized. That is, if chamber 36 does not fully expand, actuator 30 will rise to a higher than normal height before contacting diaphragm 44.

The illustrated diaphragm pump has proven to be very reliable and well suited for use in the ink supply. However, other types of pumps may also be used. For example, a piston pump, a bellows pump, or other types of pumps might be adapted for use with the present invention.

Figure 8:
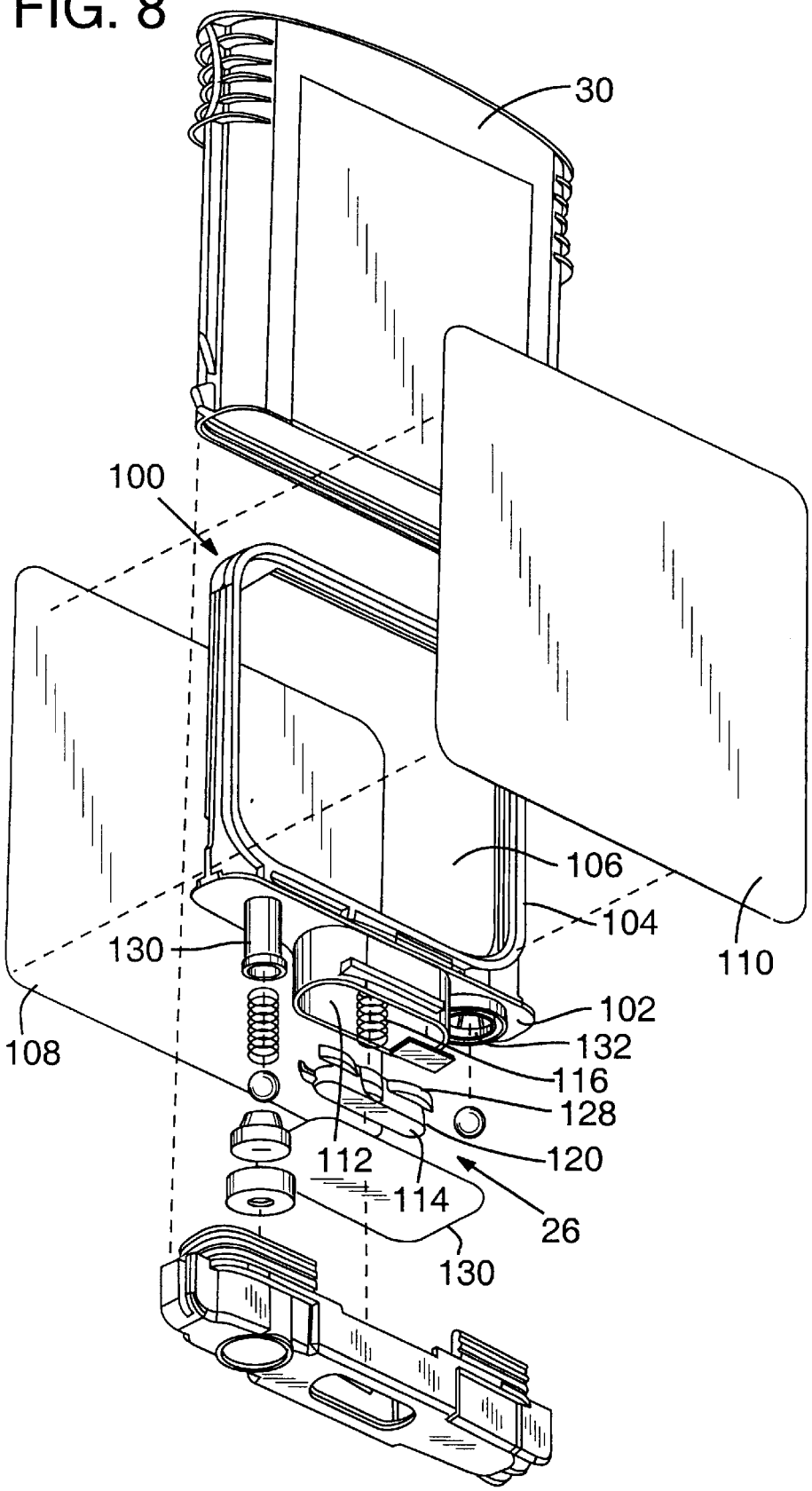
FIG. 8 is an exploded view of another embodiment of the ink supply.

An alternative embodiment of an ink supply 100 is illustrated in FIG. 8, wherein a chassis 102 has a reservoir frame 104 extending upwardly therefrom. Frame 104 defines a reservoir 106 that is generally square in vertical cross-section, and the thickness of reservoir 106 is determined by the thickness of frame 104. The frame defines opposing, parallel open square faces, to which two opposing parallel, substantially square sheets of plastic 108, 110 are attached to enclose reservoir 106.

The illustrated plastic sheet is flexible to allow the volume of the reservoir to vary as ink is depleted from the reservoir. This helps allow withdrawal and use of all the ink within the reservoir by reducing the amount of backpressure created as ink is depleted from the reservoir. The illustrated ink supply 20 is intended to contain about 30 cubic centimeters of ink when full.

In the illustrated embodiment, sheets 108, 110 are heat staked to the faces of the frame in a manner well known to those in the art. To facilitate the heat staking process, the chassis is molded of high density polyethylene and the plastic sheet is low density polyethylene that is 0.002 inches thick. These two materials can be easily heat staked using conventional methods and are also readily recyclable.

The reservoir 106 formed between sheets 108, 110 is filled with ink through fill port 130. Ink leaves the reservoir through ink outlet 132. Ink is drawn into a pump chamber 112 and expelled into a supply tube (not shown in FIG. 8) through outlet 132 in a manner analogous to that already described in connection with FIGS. 3–7 above.

Figure 9:
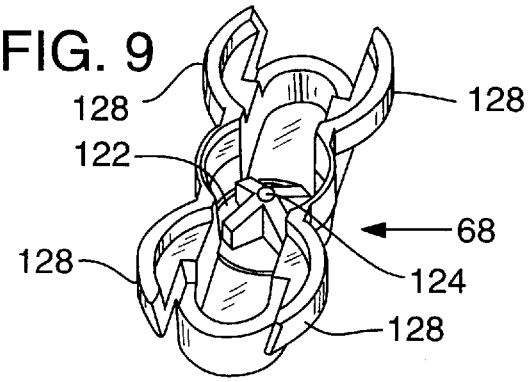
FIG. 9 is an enlarged, top perspective view of the pressure plate in the embodiment of FIG. 8.
Figure 10:
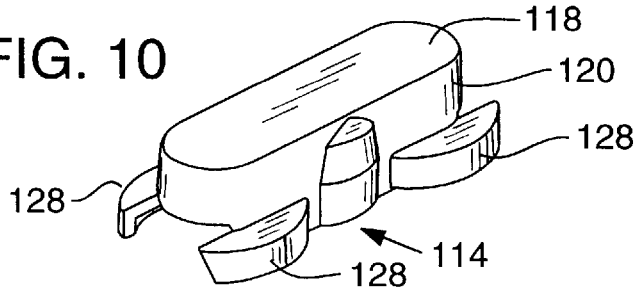
FIG. 10 is a bottom perspective view of the pressure plate of FIG. 9.

A pressure plate 114 and a spring 116 are positioned within chamber 42. The pressure plate 114, illustrated in detail in FIGS. 9 and 10, has a smooth lower face 118 with a wall 120 extending upward at its perimeter. A central region 122 of the interior face of pressure plate 114 is shaped to receive the lower end of the spring 116 and is provided with a spring retaining spike 124. Four stabilizing wings 128 extend laterally from an upper portion of the wall 120.

Pressure plate 114 is positioned within chamber 112 with lower face 118 adjacent a flexible diaphragm 130. The upper end of spring 116, which is stainless steel in the illustrated embodiment, is retained on a spike (not shown) formed in the chassis, and the lower end of spring 116 is retained on the spike 124 on pressure plate 114. In this manner, the spring biases pressure plate 114 downward against diaphragm 130 to increase the volume of the chamber 112. Wall 120 and wings 128 serve to stabilize the orientation of the pressure plate while allowing for its free, piston-like movement within chamber 112.

Figure 2:
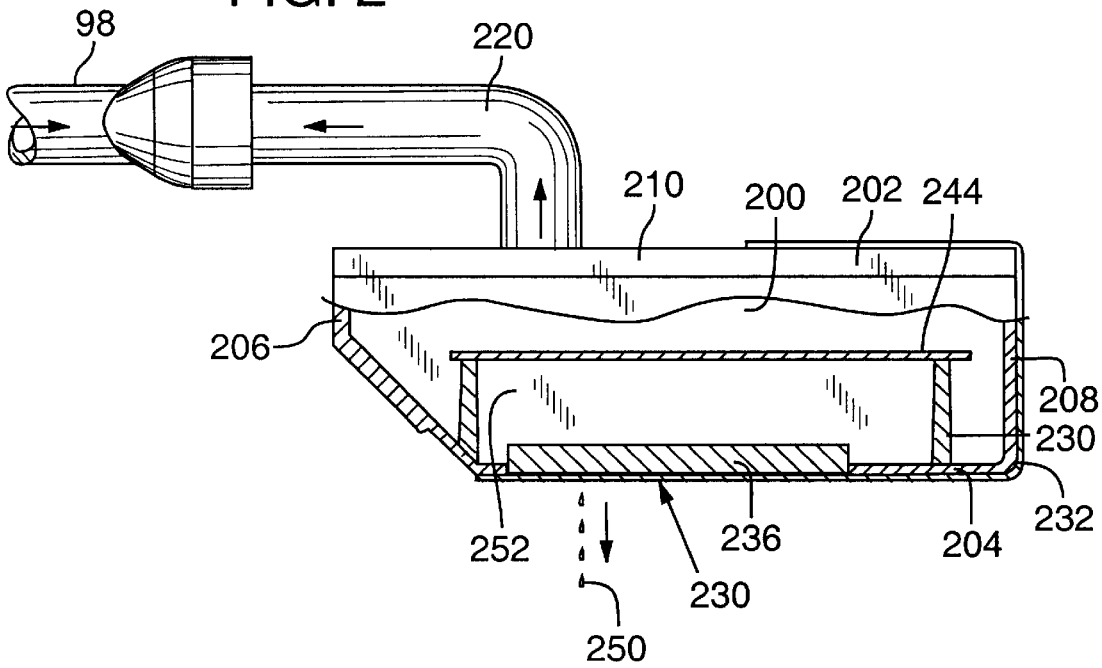
FIG. 2 is a side view of the pen body shown in FIG. 1, with an ink containment chamber shown partially in cross-section.
Figure 2A:
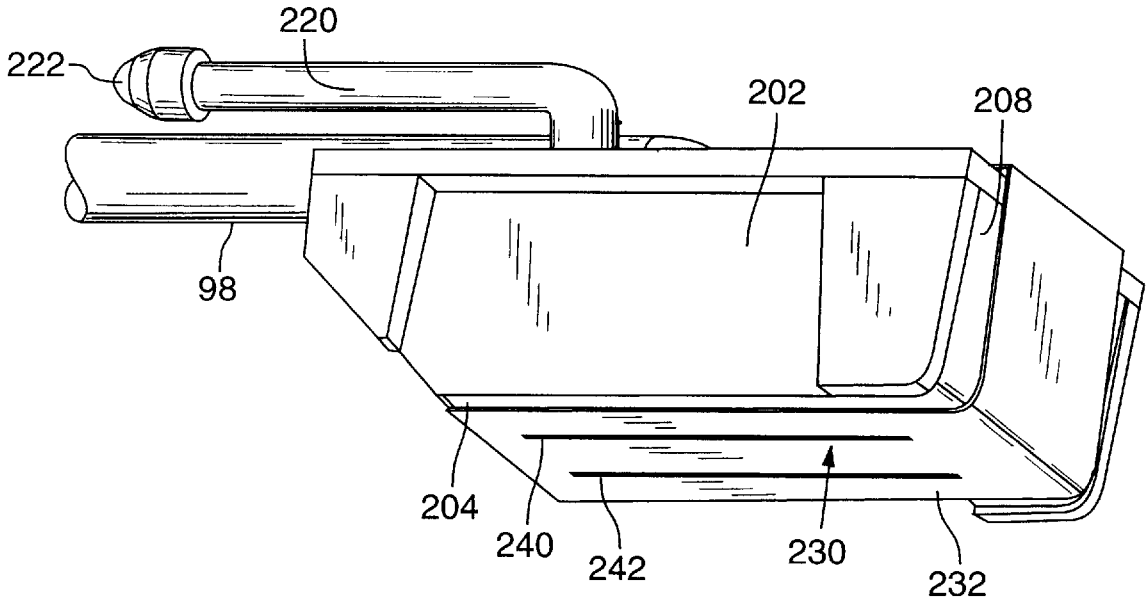
FIG. 2A is a bottom perspective view of the pen body of FIG. 1 with the aligned nozzle orifices on the printhead face.
Figure 2B:
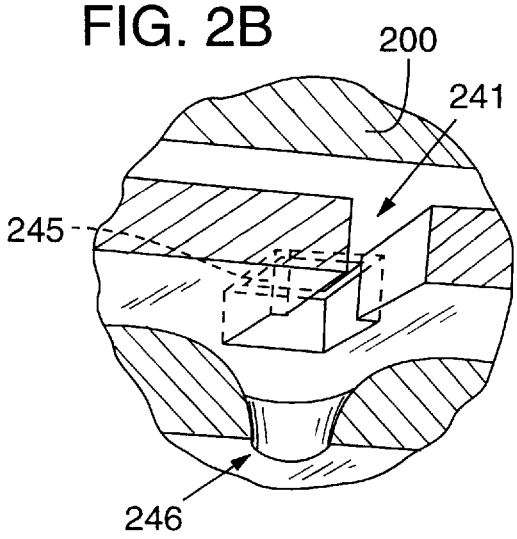
FIG. 2B is an enlarged schematic view of one of the nozzle orifices and an associated droplet generator.

Ink jet pen 11 is shown in greater detail, in FIGS. 1, 2, 2A and 2B, to include a single shallow containment chamber 200 (FIG. 2) having opposing identical side walls 202 (only one side wall is shown in FIGS. 1 and 2), a print head supporting face 204, a rear wall 206 and front wall 208. A lid 210 seals the top of pen 11, and has an inlet 214 and outlet 216 therethrough which communicate with chamber 200. Supply tube 98 communicates with inlet 214, through which ink from supply 10 or 100 is introduced directly into chamber 200 without first passing through a pressure regulator mounted on the pen. A purge tube 220 communicates with outlet 216 to allow flushing of air out of chamber 200 as the chamber fills with ink. A one way check valve, such as duck-billed valve 222, opens when air pressure in purge tube 220 exceeds a preselected pressure (for example 2 psi) to vent air out of chamber 200 as the chamber fills with ink. One-way valve 222 does not admit ambient air into purge tube 220, even if there is a negative pressure in the pen body chamber 200.

A flex circuit 232 is adhered to printhead supporting face 204, and the exterior faces of front wall 208 and lid 210. Printhead supporting face 204 has a rectangular opening for receiving a tab head assembly 230 that includes a portion of flex circuit 232 with an adhered silicon die 236 that seats within the rectangular opening. The portion of flex circuit 232 that extends on to lid 210 contains electrical connectors 234 for interconnection with conventional electronic circuitry that controls firing of the printhead. Signals from connectors 234 are carried in electrical tracings on flex circuit 232 to the printhead.

On printhead supporting face 204 of the pen body, two rows of small multiple aligned orifices 240, 242 (FIG. 2A) extend through the flex circuit 232 and communicate with ink inlet channels 241 (FIG. 2B) in the edges of silicon die 236. Channels 241 communicate with chamber 200 to convey ink from the chamber 200 to a firing chamber 243 below one of the orifices 246 in one of the lines of orifices 240 or 242. As known in the art, flex circuit 232 activates small resistors 245 in firing chamber 243 to heat ink and expel small ink droplets 250 (FIG. 2) through the orifices in a controlled fashion to propel ink to a substrate (not shown) such as a paper surface in the ink jet printer. The printhead mechanism is thus a conventional droplet generator.

A filter screen 244 (FIG. 2) is provided in chamber 200 to prevent particulate matter in chamber 200 from entering the inlet channels 241 or printhead orifices. Screen 244 is suspended above bottom wall 204 by a rectangular, open top enclosure 252 (only two walls of which are shown in cross-section in FIG. 2). Ink is thereby filtered through screen 244 and enters a filter enclosure 252 before being pulled into the droplet generator. Ink flows freely through screen 244, and its passage is not regulated by the screen. Enclosure 252 is a subcompartment of chamber 200, and is in free fluid communication with chamber 200 (i.e., there are no regulating valves controlling entry of ink into enclosure 252).

Figure 11:
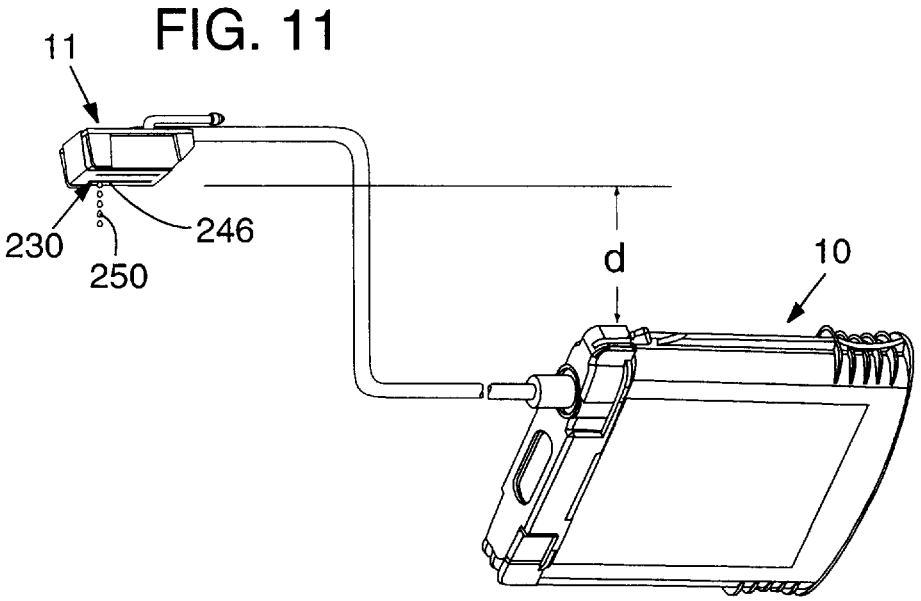
FIG. 11 is a schematic view demonstrating the spatial relationship of the ink supply and pen to maintain a back-pressure from the pen to the ink supply.

A backpressure is maintained on ink in chamber 200 by placing ink supply 10 at a lower elevation than pen body 11, as shown schematically in FIG. 11. The bottom face 204 of pen 11 (through which orifices 240, 242 emerge) is preferably disposed horizontally, at an elevation above the highest level of ink in supply 10. For purposes of illustration, the bottom face of the pen is shown spaced above the top of supply 10 (or more particularly reservoir 14) by a distance d, where d is preferably about three inches. A preferred range of $\Delta P$ from pen containment chamber 200 to ink in reservoir 14 is from 0.5 to 50 inches of water, preferably about 1–15 inches of water, and in more specific embodiments about 1–3 inches of water. This backpressure inhibits drooling of ink from the printhead orifices. The backpressure can be varied by changing the position of the ink reservoir while maintaining the surface of the ink in the reservoir 14 slightly below the level of the rows of aligned nozzles 240, 242.

Alternatively, the underpressure may be achieved by using a bladder type ink reservoir made of an elastic material that progressively collapses as ink is drawn from the elastic reservoir. The restorative force of the flexible bladder keeps the pressure of the ink in the reservoir slightly below ambient pressure. In yet another embodiment, a spring could be placed in reservoir 14 to counteract collapse of the reservoir as the ink supply is exhausted, and maintain backpressure.

The low profile pen body of the present invention may be made in many sizes. The dimensions of one preferred embodiment, for example, are 9 mm high (from face 204 to lid 210), 14 mm wide (between side walls 202) and 25 mm long (between walls 206, 208). The height of pen body 11 (as measured between the exterior faces of bottom wall 204 and lid 210) is preferably less than 15 mm, and more preferably less than 10 mm. This low printhead profile is possible because a regulator is not carried by the printhead for maintaining a backpressure on ink in the pen body. The low profile is particularly advantageous because it permits the ink jet printer which contains the printhead to be designed with more compact dimensions. The small pen body occupies a much smaller volume in the printer, and a smaller volume is required to accommodate the pen body in its path of movement as it sweeps across over a substrate on which an image is being printed.

In operation, the ink jet printer is assembled and shipped in a "dry" condition, that is without priming the printer by introducing ink into the supply tube 98 and pen body 11. At the time the printer reaches its destination, supply line 98 is attached to supply 10, but the supply line is still filled with air, not ink. The empty supply line increases the shelf life of the printer because the inks contain chemicals that are corrosive to the supply line and other printer components. In addition, liquids and chemicals may evaporate through the tubing of a filled supply line, which potentially causes formation of a residue that can plug the supply line over extended periods of storage. The unfilled supply line, however, makes it necessary to fill the line with ink during "initialization" of the printer.

Initialization refers to the process of filling the supply line 98 and pen body 11 with ink, and priming the printhead. "Priming" the printhead refers to introducing ink into the inlet channels 241 and/or orifices 240, 242, with a continuous fluid supply of ink from chamber 200, such that ink is then drawn by capillary forces into the orifices from chamber 200 as droplets 250 are expelled from the printhead. Supply line 98 and containment chamber 200 are part of an ink flow path to the printhead. The ink flow path also includes the printhead with a plurality of capillary passageways 241 and the rows of aligned orifices 240, 242 communicating with the passageways.

Supply 10 is docked in docking bay 26 as earlier described, with fluid connections established between reservoir 14, pump chamber 36, and fluid outlet 20. After supply 10 is coupled with docking bay 26, pump chamber 36 and conduit 66 are filled as earlier described, for example by applying a partial vacuum to fluid outlet 20. Docking of the supply 10 preferably occurs prior to shipment from a manufacturing facility. Filling the reservoir 14 with ink may be accomplished either at the factory, or subsequently after use when the ink supply is exhausted and must be refilled. Either before or after shipment, supply line 98 is connected to fluid inlet 28 by a quick connect mechanism.

Initialization occurs after reservoir 14 has been filled with ink, and preferably occurs after shipment, because the present invention advantageously permits the printer to be shipped without ink in the supply line 98. During initialization, pump 18 is actuated by rotating cam 120 to advance actuator 30 and compress pressure plate 46 against the bias of spring 48, reducing the volume of pump chamber 36. This reduced volume exerts a positive pressure on the ink in chamber 36 relative to chamber 200, overcoming any back pressure and forcing the ink through supply line 98, and into chamber 200 of pen body 11. Once in chamber 200, the ink fills capillary passageways 242, and enters chamber 243.

The pen body ink containment chamber 200 and supply line 98 are preferably completely filled with ink during the initialization procedure. Filling the pen body chamber and supply line 98 with ink moved under positive pressure (e.g., 1–15 psi, more particularly 1–2 psi) from the reservoir has the advantage of flushing air out of the ink supply path between the reservoir 14 and orifices 240, 242. The air that, prior to initialization, fills supply line 98 and pen body chamber 200 is exhausted out of line 220 and check valve 222 as chamber 200 fills with ink. As a result, a continuous supply of ink is present from the pump chamber, through supply 98, into pen body chamber 200, through the inlet channel 241 of the printhead, and into the aligned firing chambers 243. The continuous column of ink thereby provided allows the pen to operate efficiently by continuing to draw ink into the firing chambers 243 by capillary action.

After initialization, ink fills chamber 200, and cam 120 is rotated to move lever 116 against the bias of spring 118, retract actuator 30 from pump chamber 36, and permit chamber 36 to fully expand and fill with ink. A slight pressure differential (e.g., 3 to 15 inches $H_2O$, and more particularly 3 to 5 inches $H_2O$) is maintained between the ink in chamber 200 and in reservoir 14, such that the backpressure on chamber 200 inhibits drooling of ink from the orifices of the printhead. Pressurization of chamber 36 by advancing plates 46 into the chamber 36 can subsequently overcome the negative pressure differential at the pen chamber 200 with respect to the ink supply, and instead produces a positive pressure in the chamber that forces ink out of chamber 36 into supply line 98. However, during normal operation of the printer, chamber 36 is fully expanded. As ink droplets 250 are expelled from chamber 200 during printing, more ink through capillary inlet channels 241 from chamber 200 by capillary action. As ink in the pen is used, ink is drawn through line 98 from pump chamber 36 by hydraulic force.

Pen operation and print quality can be degraded, however, if air bubbles enter the flow path. Air, for example, may be gulped in through printhead orifices or fluid interconnects, or may even diffuse through printer components. When this occurs, air bubbles can occlude the capillary lines 242, and interfere with efficient capillary flow of ink to the firing chambers 243. Moreover, ink that has been present in the supply line during prolonged periods of printer inactivity may be unsuitable for printing (for example, because of evaporation through the supply tube). An advantage of the disclosed system is that it is capable of flushing the flow path to remove occlusions such as air, or displace stale ink with fresh ink from a reservoir.

Flushing is performed by first moving pen 200 to a capping station (not shown) which seals the nozzle orifices 240, 242 and provides a drain into which ink may be expelled. Alternatively, the pen may be moved to a spittoon (not shown) into which ink may be freely expelled without fouling other printer compounds. Then cam 120 is rotated to decrease the volume of pump chamber 36 from that shown in FIG. 4 and introduce ink under positive pressure (1–3 psi) through the ink flow path. The ink already present in the flow path is completely replaced by ink from chamber 36, thereby filling supply line 98, chamber 200, capillary inlet channels 241, and firing chambers 243. Ink which previously filled that flow path is forced out of orifices 240, 242 and into the capping station or spittoon. Any air, such as bubbles, is removed from the flow path in this manner to restore print quality that may have been previously degraded by bubbles occluding capillary supply lines or other components. Flushing may be used at any time to recover print quality when it declines because of air at any point in the ink flow pathway, particularly at the capillary inlet lines or printhead orifices.

Maintenance of a backpressure from the ink supply to the pen body (through the supply line) eliminates the need for complex pressure regulating mechanisms carried by the pen. The smaller pen occupies less room in the printer, allowing a smaller printer profile. Elimination of a separate air purge circuit also reduces the size and complexity of the printer. The cost of the printer is potentially reduced because of the elimination of the disposable pressure regulator, and a less need for materials in the smaller printer. Lower carriage mass also allows the use of a smaller drive motor.

Although the ink supply and pen have been illustrated as having a single ink supply, the disclosed system can easily be adapted for use with multiple ink supplies, for example multiple reservoirs and pens for different colors of ink. Other modifications of the system are possible, for example a backpressure is maintained from the ink supply to the pen body by regulating the position of plate 46 in pump 18 to prevent ink from drooling out of the printhead orifice when the printer is moved. Also, when the printer is inactive, the pen may return to a "home" position, and tube 98 is closed to prevent loss of ink through the printhead. Tube 98 can be closed either physically (pinching closed a collapsible tube 98) or mechanically (a valve would be provided in line 98, and be closed when the printer is inactive with the pen in the home position).

This detailed description is set forth only for purposes of illustrating examples of the present invention and should not be considered to limit the scope thereof in any way. Clearly, numerous additions, substitutions, and other modifications can be made to the invention without departing from the scope of the invention which is defined in the appended claims and equivalents thereof.

What is claimed is:

1. A method of priming an ink jet pen with ink, comprising the steps of:

providing an ink jet pen body having a containment chamber for holding ink, and printhead orifices in free fluid communication with the containment chamber;

providing a supply of ink remote from and not carried by the ink jet pen body;

providing a supply line between the containment chamber and supply of ink, through which supply line ink is hydraulically drawn from the supply of ink during printing as ink is expelled from the printhead orifices;

introducing the ink under positive pressure from the remote supply of ink into the ink supply line and containment chamber to flush air from the supply line and containment chamber prior to beginning printing; and maintaining a back pressure from the supply of ink to the containment chamber, with a relatively negative pressure at the supply of ink, to prevent drooling of ink from the printhead orifice;

the supply line including a docking bay having a fluid inlet coupled to the supply line, a reservoir that couples with the docking bay and contains the ink, and a pump that draws ink from the reservoir and introduces the ink under pressure into the supply line; and the step of introducing ink under pressure including actuating the pump to introduce the ink under pressure into the supply line and containment chamber until the ink forms a continuous supply of ink that fills the supply line and containment chamber, displacing the air from the supply line and containment chamber, while venting the air out of the containment chamber.

2. The method of claim 1 wherein the step of introducing the ink under positive pressure further comprises introducing the ink under positive pressure into the containment chamber while venting the air from the containment chamber until the containment chamber is completely filled with the ink, and an uninterrupted supply of ink extends from the supply of ink to the containment chamber.

3. The method of claim 1 wherein the step of introducing the ink under pressure comprises providing a chamber pump containing ink in a variable volume chamber, and expelling ink from the chamber pump into the supply line under positive pressure by reducing the chamber volume.

4. The method of claim 1 wherein the step of maintaining the back pressure at the supply of ink comprises placing the supply of ink at a sufficiently lower elevation than the containment chamber that a back pressure is exerted through the supply line from the supply of ink to the ink in the containment chamber.

5. The method of claim 1 wherein an ink flow path comprises the supply line and the ink containment chamber, and the method further comprises the step of venting the air from the ink flow path while introducing the ink under positive pressure into the supply line and containment chamber.

6. The method of claim 5 wherein the step of introducing the ink under positive pressure into the supply line and containment chamber comprises completely filling the ink flow path with an uninterrupted supply of the ink.

7. The method of claim 5 wherein the step of venting the air from the ink flow path comprises forcing the air from the supply line with the ink introduced under positive pressure into the supply line.

8. The method of claim 5 wherein the step of venting the air from the ink flow path comprises allowing air to leave the containment chamber through an air outlet valve while filling the supply line and the containment chamber with the ink.

9. The method of claim 1 further comprising, subsequent to the step of introducing the ink under positive pressure into the supply line and containment chamber, the step of again introducing the ink under positive pressure into the supply line and the containment chamber to remove air that enters the supply line and the containment chamber.

10. A method of priming an inkjet pen with ink, comprising the steps of:

providing an ink jet pen body having a containment chamber for holding ink, and printhead orifices in free fluid communication with the containment chamber;

providing a supply of ink remote from and not carried by the ink jet pen body;

providing a supply line between the containment chamber and supply of ink through which supply line ink is hydraulically drawn from the supply of ink during printing as ink is expelled from the printhead orifices;

introducing the ink under positive pressure from the remote supply of ink into the ink supply line and containment chamber to flush air from the supply line and containment chamber prior to beginning printing; and in response to a preselected signal introducing the ink under positive pressure into the supply line and the containment chamber to remove air that enters the supply line and the containment chamber.

11. The method of claim 10 wherein the step of again introducing the ink comprises introducing the ink under pressure into the supply line and containment chamber in response to a signal that indicates a pneumatic occlusion is present in the ink flow path.

12. The method of claim 10, wherein the step of again introducing the ink comprises introducing the ink under positive pressure into the supply line and containment chamber at periodic preselected times.

13. An ink jet printer, comprising:

a chassis;

a docking bay having a pump actuator and a fluid inlet coupled to a supply line;

an ink jet pen comprising an ink containment chamber with a printhead having an orifice coupled with a droplet generator for expelling droplets of ink through the orifice, and the orifice communicates with a firing chamber that in turn communicates with the containment chamber through a capillary supply line;

a reservoir coupled to the chassis for containing a quantity of ink;

a flexible supply line between the reservoir and containment chamber that establishes an uninterrupted fluid pathway from a supply of ink to the firing chamber, such that ink is drawn into the firing chamber by capillary action as the droplets of ink are expelled through the orifice, which in turn draws ink into the containment chamber from the supply line without passing through a pressure regulator;

further wherein the reservoir is at a sufficiently lower elevation than the firing chamber to establish through the supply line a negative pressure on ink in the containment chamber relative to ink in the reservoir to inhibit drooling of ink out of the orifice when the reservoir, supply line and containment chamber contain ink;

a fluid outlet from the reservoir that couples with the fluid inlet in the chassis and establishes a fluid connection therewith when the ink supply is in a docked position, and the supply line communicates with the reservoir through the fluid outlet;

a variable volume pump carried on the chassis, wherein the pump has a pump chamber in fluid communication with the reservoir and fluid outlet, and the pump chamber communicates with the reservoir through a one-way valve that allows ink to flow only from the reservoir to the pump chamber; and a supply line occluder that is activated when the ink jet printer is inactive to occlude the supply line and inhibit drooling of ink from the orifice:

wherein the pump is actuatable by the actuator when the ink supply is in the docked position to enlarge a pump chamber volume and to draw ink from the reservoir through the one-way valve, then subsequently to supply the ink under positive pressure through the fluid outlet to the supply line and containment chamber by reducing the pump chamber volume.

14. The ink jet printer of claim 13 further comprising an air purge valve communicating with the containment chamber, and through which air is purged from the containment chamber as the chamber fills with ink.

15. The ink jet printer of claim 14 wherein the ink jet pen has a single containment chamber, and that chamber communicates directly with the supply line.

16. The ink jet printer of claim 13 further comprising an air purge valve communicating with the supply line, and through which air is purged from the supply line as the supply line fills with ink.

17. The ink jet printer of claim 13 wherein the ink jet pen has a single containment chamber, and that chamber communicates directly with the supply line.

18. A method of priming an ink jet pen with ink, comprising the steps of:

providing an ink jet pen body having a containment chamber for holding ink, and printhead orifices in free fluid communication with the containment chamber;

providing a supply of ink remote from and not carried by the ink jet pen body;

providing a supply line between the containment chamber and supply of ink, through which supply line ink is hydraulically drawn from the supply of ink during printing as ink is expelled from the printhead orifices;

introducing the ink under positive pressure from the remote supply of ink into the ink supply line and containment chamber to flush air from the supply line and containment chamber prior to beginning printing;

the step of maintaining a back pressure from the supply of ink to the containment chamber, with a relatively negative pressure at the supply of ink, to prevent drooling of ink from the printhead orifice; and the step of maintaining the back pressure at the supply of ink including using the pump to maintain a negative pressure on the ink in the supply line and containment chamber relative to the ink in the supply of ink.

19. A method of supplying ink for an ink jet printer having a docking station with a pump actuator and a fluid inlet coupled to a supply line for providing the ink to a movable printhead, the method comprising the steps of:

providing a replaceable ink supply comprising a chassis, a reservoir containing a quantity of ink coupled to the chassis, a fluid outlet carried on the chassis, a pump carried on the chassis and having a variable volume chamber, a pump inlet in fluid communication with the reservoir and the variable volume chamber, and a pump outlet in fluid communication with the variable volume chamber and fluid outlet, and a valve positioned in the pump inlet for allowing a flow of ink into the variable volume chamber and limiting the flow of ink from the variable volume chamber to the reservoir;

providing an ink jet pen comprising an ink containment chamber in direct fluid communication, through the supply line, with the fluid outlet, wherein a printhead of the ink jet pen has a plurality of orifices, with associated firing chambers in fluid communication through capillary supply lines with the ink containment chamber, wherein ink is drawn into the firing chambers by capillary action from the ink containment chamber as ink is expelled in droplets through the printhead orifice;

providing a purge valve that vents air from the ink containment chamber;

inserting a replaceable ink supply into a docking position within the docking station with the fluid outlet of the chassis in fluid communication with the pump outlet;

expanding the variable volume chamber of the pump to draw the ink from the reservoir into the pump;

then reducing the volume of the variable volume chamber to expel the ink from the pump into the fluid outlet and the supply line, until the ink containment chamber is filled with the ink, and all air in the supply line and the ink containment chamber is vented out of the check valve; and expelling droplets of ink from the firing chambers of the printhead to reduce the volume of ink in the ink containment chamber, which draws the ink into the firing chamber by capillary action, which in turn draws the ink into the containment chamber through an uninterrupted contiguous liquid line of ink from the ink supply to the supply line into the containment chamber and firing chamber.

20. The method of claim 19 further comprising the step of positioning the ink supply at a sufficiently lower elevation relative to the firing chambers of the printhead that a relatively negative pressure is exerted, through the supply line, on the ink in the ink containment chamber relative to the ink in the supply of ink during printing to inhibit drooling of ink out of the orifices.

* * * * *